United States Patent [19]

Parsons

[11] 4,010,846

[45] Mar. 8, 1977

[54] SAFETY MATCH BOOK

[76] Inventor: James Henry Parsons, 4715 N. Forest Road, Hixson, Tenn. 37343

[22] Filed: Nov. 20, 1975

[21] Appl. No.: 633,985

[52] U.S. Cl. ..... 206/108; 206/813

[51] Int. Cl.[2] ..... A24F 27/00

[58] Field of Search ..... 206/85, 90, 92–93, 206/96, 104, 106–109, 112–114

[56] References Cited

UNITED STATES PATENTS

| | | | |
|---|---|---|---|
| 2,102,580 | 12/1937 | Mahon | 206/113 |
| 2,143,083 | 1/1939 | Neville | 206/112 |
| 2,250,000 | 7/1941 | Baldwin | 206/109 |
| 2,350,144 | 5/1944 | Barros | 206/112 |
| 2,765,072 | 10/1956 | Will | 206/115 X |

*Primary Examiner*—Steven E. Lipman
*Attorney, Agent, or Firm*—Stevens, Davis, Miller & Mosher

[57] ABSTRACT

A safety match book is disclosed in which the striking strip is not normally sufficiently exposed for the striking of matches thereon and can only be exposed by releasing an interconnection between a panel of the cover on which the striking strip is mounted and a retainer flap. The releasable interconnection may be in the form of a pair of adhesive strips immediately adjacent and on opposite sides of the striking strip. The cover may be made thin and of a material which is easily tearable. As a result, if a child or other person not aware of the danger of matches, picks up the matches and attempts to open them, the cover will tear without releasing the interconnection between the panel of the cover and the retainer so that the striking strip is not exposed and the matches therefore cannot be struck thereon.

31 Claims, 13 Drawing Figures

FIG. 1
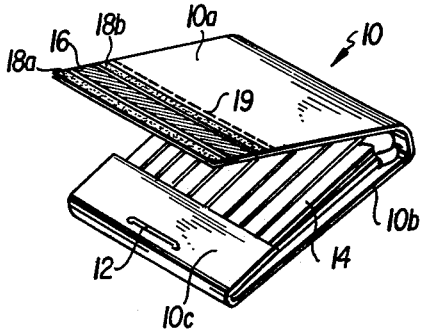
FIG. 2
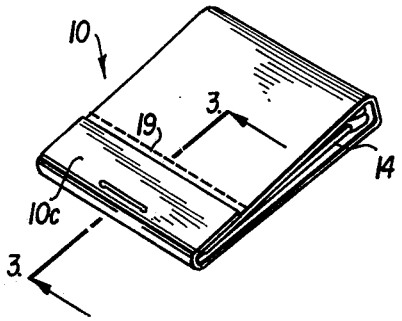
FIG. 3
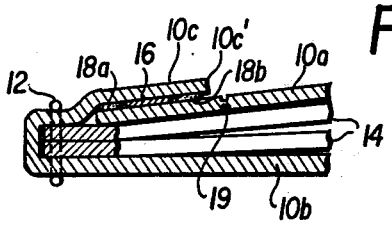
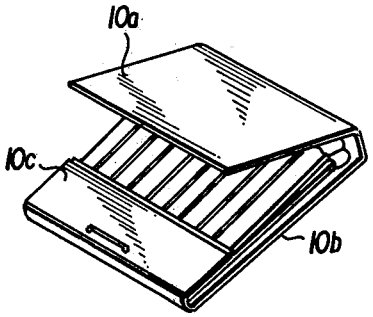
FIG. 5
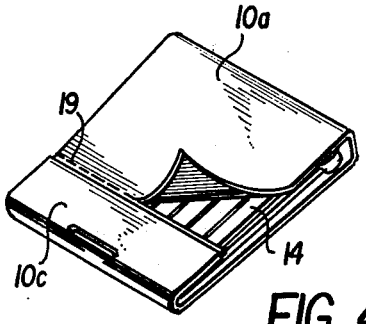
FIG. 4

FIG. 6
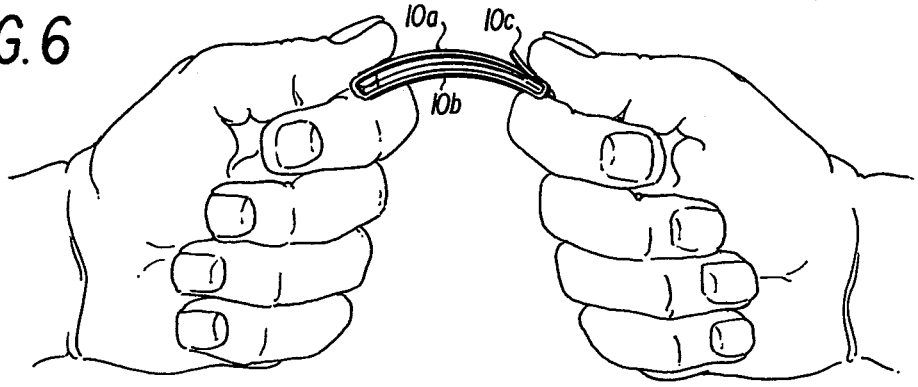
FIG. 7
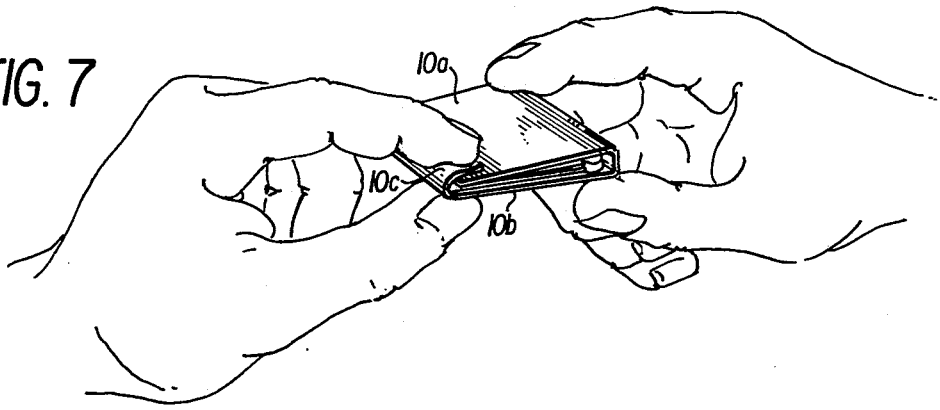
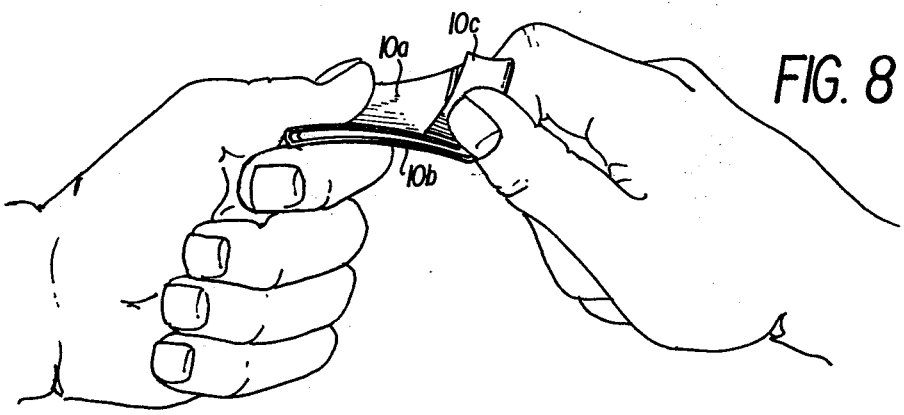
FIG. 8
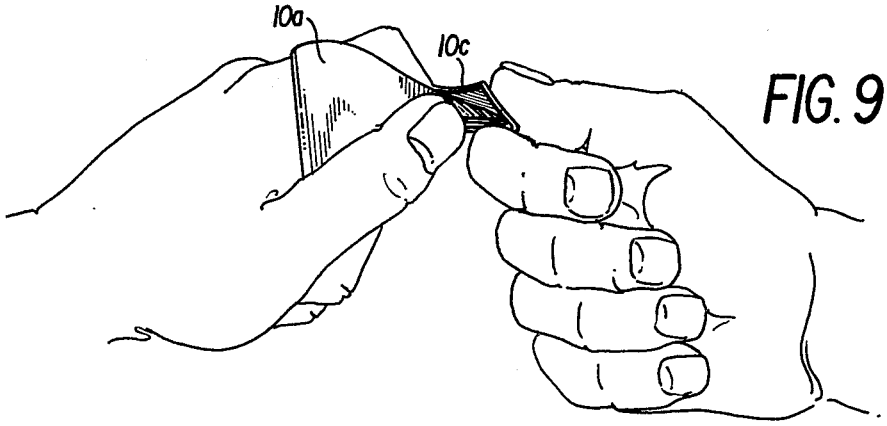
FIG. 9

SAFETY MATCH BOOK

BACKGROUND OF THE INVENTION

1. Field of the Invention

This invention relates to safety match books. More specifically, the invention relates to a safety match book in which the striking strip is not normally sufficiently exposed for the striking of matches thereon and can only be exposed by releasing an interconnection between a panel of the cover on which the striking strip is mounted and a retainer flap.

2. Description of the Prior Art

In conventional match books, the striking strip on the cover is either normally exposed or easily exposable so that if young children or other persons who do not appreciate the dangers in the use of matches, play with or handle the matches, it is likely that they will ignite the matches by striking them on the striking or friction strip and potentially burn themselves or other things around them.

SUMMARY OF THE INVENTION

This invention relates to a safety match book in which the striking strip is not normally exposed nor easily exposable so that children or other persons not familiar with the danger of matches cannot ignite the matches because a striking surface area or strip, on which matches could be struck, is not normally sufficiently exposed to do so.

The safety match book of this invention includes a match book cover having a front panel closure flap, a back panel connected at one end to one end of the front panel closure flap, and a retainer flap extending from the other end of the back panel. Matches are secured between the back panel and the retaining flap and are adapted to be partially enclosed by the closure flap. A friction strip is positioned on the other end of the front panel closure flap and that end and the friction strip thereon are normally positioned between the retainer flap and the matches so that the friction strip is not exposed for striking of the matches thereon. The other end of the closure flap and the retainer flap are releasably connected whereby the friction strip can be exposed for striking of the matches thereon by release of the interconnection between the closure flap and the retainer flap so that the other end of the closure flap and the friction strip thereon can be removed from normal position between the retaining flap and the matches. The match book cover is preferably thin and made of a material which is easily tearable. As a result, if a child or other person not familiar with the dangers of matches attempts to open the match book, they will most likely tear the cover without breaking the interconnection between the closure flap and the retainer flap so that the striking area will not be exposed. As a result, the matches can only be removed from the book and since the friction strip is not exposed, those persons will be unable to ignite the matches. In one embodiment of the invention, the releasable interconnection is in the form of a pair of adhesive strips on the other end of the front panel closure flap immediately adjacent and on opposite sides of the friction strip. The front panel closure flap may have a line of tear perforations cut therein adjacent and substantially parallel to the friction strip and positioned immediately adjacent the free edge of the retainer flap when the front panel closure flap is in its normal position. As a result, when one not familiar with the proper manner of opening the match book to expose the striking area handles the matches, he will most likely tear open the front closure flap along the line of the perforations cut therein and not expose the striking area.

In another embodiment of the invention, the match book includes a cover having an openable front panel, a back panel connected at one end to one end of the front panel, and a retainer flap extending from the other end of the front panel. Matches are secured between the front panel and the retaining flap and are adapted to be partially enclosed by the back panel. In this embodiment, the back panel is secured between the matches and the retainer flap. A friction strip is mounted on the other end of the back panel and that other end and the friction strip thereon are normally positioned between the retainer flap and the matches so that the friction strip is not normally sufficiently exposed for striking of the matches thereon. The retainer flap and the other end of the back panel are releasably interconnected whereby the friction strip can only be exposed for striking of the matches thereon by release of the interconnection of the retainer flap and the back panel so that the retainer flap can be pulled away from the back panel and the friction strip to expose the striking strip for striking of the matches thereon. The releasable interconnection is disclosed in the form of a pair of adhesive strips on the other end of the back panel immediately adjacent and on opposite sides of the strip. In this embodiment, the front panel may have a transversely extending line of perforations cut therein whereby the front panel can be easily opened by tearing along the perforations. The line of perforations may be advantageously positioned adjacent the other end of the front panel. Again, in this embodiment, if a child or other person not familiar with the danger of matches, should open the book, the striking area would not be exposed even if the front panel had already been torn along the line of perforations cut therein. The only way the striking strip would be exposed would be by releasing the interconnection of the back retainer flap and the back panel in a specific manner which a child would probably not realize.

From the foregoing, it is apparent that this invention has as one of its principal objects, the provision of a match book which is safe because the striking strip is not normally sufficiently exposed for striking of the matches thereon. This object is accomplished in part by the provision of a releasable interconnection between the part of the match book cover on which the striking strip is mounted and a retainer flap with the striking strip normally being positioned between the retainer flap and matches in the book so that the striking strip cannot normally be sufficiently exposed for the striking of matches thereon except upon release, in a specific manner, of the interconnection between the part of the cover on which the striking strip is mounted and the retainer flap.

It is a further object of this invention to provide a safety match book to reduce burn injuries to children and other persons not familiar with the dangers of matches.

It is a further object of this invention to provide a match book which is simple in construction and easy to manufacture and yet is safe.

It is a further object of this invention to provide a safety match book in which the striking strip is not normally sufficiently exposed for the striking of matches thereon.

It is a further object of this invention to provide a safety match book in which the friction strip can only be exposed by release of an interconnection between parts of the cover of the match book.

BRIEF DESCRIPTION OF THE DRAWINGS

FIG. 1 is a perspective view of a first embodiment of the invention showing the front panel closure flap in open position;

FIG. 2 is a view similar to FIG. 1 showing the front panel closure flap in its normal position with the striking strip positioned between the retainer flap and the matches;

FIG. 3 is a cross-sectional view along line 3—3 of FIG. 2;

FIG. 4 is a perspective view similar to FIG. 1 but showing the front panel closure flap partially torn along the line of perforations cut therein;

FIG. 5 is a view similar to FIG. 4 but showing the front panel closure flap completely open after it has been torn along the line of perforations cut therein;

FIGS. 6 and 7 show one manner of opening the match book to expose the striking strip;

FIGS. 8 and 9 show another manner of opening the match book to expose the striking strip;

DESCRIPTION OF THE PREFERRED EMBODIMENTS

Figure 10:
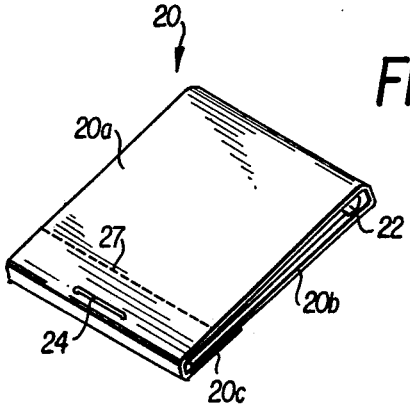
FIG. 10 is a perspective view of a second embodiment of the invention.
Figure 11:
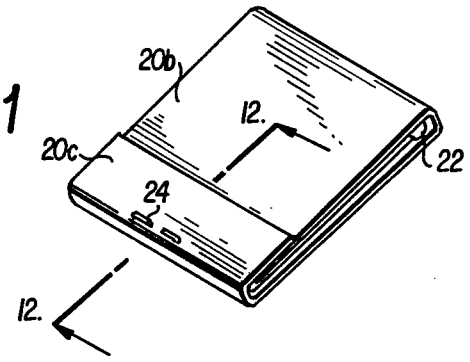
FIG. 11 is another perspective view of the second embodiment of the invention.

With reference to FIG. 1, there is shown a safety match book 10 having a front panel closure flap 10*a*, a back panel 10*b* connected at one end to one end of the front panel closure flap 10*a*, and an imperforate retainer flap 10*c* extending from the other end of the back panel 10*b*. A fastening device, such as the staple 12, firmly secures the bottoms of the matches between the back panel 10*b* and the retainer flap 10*c*. The matches 14 are adapted to be partially enclosed by the closure flap 10*a*.

The cover is preferably made of relatively thin cardboard or paper. A friction strip 16 is mounted on the other end of the front panel closure flap 10*a*. The front end of the closure flap 10*a* and the friction strip 16 thereon are normally positioned, as shown in FIG. 4, between the retainer flap 10*c* and the matches 14 so that the friction strip 16 is not exposed for striking of the matches 14 thereon.

The other end of the closure flap 10*a* and the retainer flap 10*c* are releasably interconnected by means of a pair of adhesive strips 18*a*, 18*b* on the other end of the front panel closure flap 10*a* immediately adjacent and on opposite sides of the friction strip 16. When the front panel closure flap is positioned between the retainer flap 10*c* and the matches 14, as shown in FIG. 3, the pair of adhesive strips 18*a*, 18*b*, releasably interconnect the other end of the closure flap 10*a* and the retainer flap 10*c*. As a result, the friction strip 16 cannot be readily exposed for striking of the matches 14 thereon. The striking strip 16 can only be exposed by release of the releasable interconnections between the closure flap 10*a* and the retainer flap 10*c*. If the releasable interconnection is established so that it can only be released in a particular manner, children or other persons who do not appreciate the danger of matches, will not be able to release the interconnection and expose the striking area so that any matches taken from the match book cannot be struck on the friction strip 16.

With reference to FIGS. 6 – 9, the manner of opening the front panel closure flap 10*a* by release of the adhesive interconnections between the closure flap 10*a* and the retainer flap 10*c* will be described. The adhesive interconnections between the closure flap 10*a* and the retainer flap 10*c* should be strong enough to maintain the adhesive interconnection between them when one is trying to force the book open and/or attempting to tear it apart and yet weak enough to break without tearing when opened properly, for example in the following manners.

The match book 10 may properly be opened in the following manner: The match book 10 can be held at its ends and the book may then be bent as shown in FIG. 6 to break the adhesive interconnections. If the match book does not "pop" completely open, there should be enough separation between the closure flap 10*a* and the retainer flap 10*c*, as shown in FIG. 6, to insert a finger in that opening to pull the closure flap 10*a* away from the retainer flap 10*c* (FIG. 7).

With reference to FIGS. 8 and 9 another manner of properly opening the match book 10 will be described. Holding the match book 10 as shown in FIG. 8, one can lightly twist the match book 10 in the manner indicated in FIG. 8. Then, the match book 10 can be held as in FIG. 9 and twisted in the opposite direction of that of FIG. 8 to break the adhesive bond. In the event that the adhesive connections do not break, a finger may be inserted into the opening, shown in FIG. 9, between the closure flap 10*a* and the retainer flap 10*c* so that the closure flap 10*a* may be pulled from the retainer flap 10*c*.

If a child or other person, for example a mentally impaired person, not appreciating the dangers of matches attempted to open the match book, it is extremely unlikely that he would do so in the manners described above. Additionally, a child would most likely tear the book open by ripping some portion of the cover as he would a Christmas present. With the book so open, the friction strip 16 would not be exposed so any matches removed from the book by the child or other persons could not be struck against the striking strip. Consequently, the child or other person should be unable to burn themselves or other things around them.

As noted above, the cover may preferably be thin and made of a material which is easily tearable, such as thin cardboard or paper so that it can be easily torn by a child or other person without exposing the striking area. Furthermore, the cover may be weakened, scored or perforated to assist a child or other person in tearing the book open without exposing the striking area. For example, as shown in the drawings, a line of perforations 19 may be cut in the closure flap 10*a* so that, if a child or other person pulls or exerts a force on the cover, it will rip along the line of perforations to open the book and expose the matches and yet not expose the friction strip 16. Advantageously, the line of tear perforations may be cut in the front panel closure flap 10*a* adjacent and substantially parallel to the friction strip 16. As shown in FIG. 3, the line of tear perforations 19 is positioned immediately adjacent the free edge **10*c*40 of the retainer flap 10*c* when the front closure panel 10*a* is in its normal position between the retainer flap 10*c* and the matches 14. With the line of perforations so positioned, a child or other person may rip the book of matches on the flap 10*c* which will act as a support against which the closure flap 10*a* may be easily torn as shown in FIG. 4. Of course, if the closure flap 10*a* is torn and opened as in FIG. 5, the match book 10 is no longer usable because the remainder of the closure flap 10*a* with the striking strip 16 thereon cannot be gripped for removal from engagement with the retainer flap 10*c*** to expose the striking strip. However although the match book is no longer usable because the striking strip cannot be exposed, the book is child-safe and should help prevent burn injuries.

Although the retainer flap **10*c*** has been described above and shown in the drawings as imperforate, it is contemplated in this invention that it could have small perforations or holes in it. Because of the small size of such holes or perforations, the friction strip in its normal position between the retainer flap and the matches would not be sufficiently exposed for striking of the matches thereon.

Figure 12:
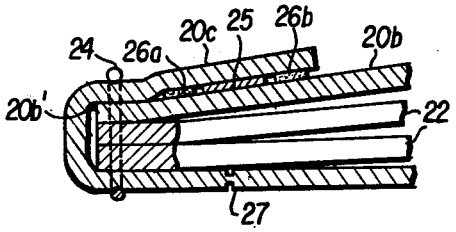
FIG. 12 is a cross-sectional view along line 12—12 of FIG. 11.
Figure 13:
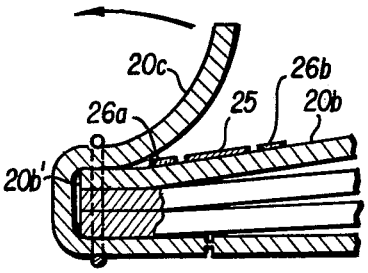
FIG. 13 is a cross-sectional view similar to FIG. 12 but showing the striking strip exposed.

With reference to FIGS. 10 through 13, a second embodiment of the invention will not be described. Shown in those FIGURES is a match book 20 having a cover which includes an openable front panel **20*a*, a back panel 20*b* connected at one end to one end of the front panel 20*a*, and a retainer flap 20*c* extending from the other end of the front panel 20*a*. Matches 22 and the back panel 20*b* are secured, for example by a staple 24, between the front panel 20*a* and the retaining flap 20*c*. As shown in FIG. 12, the staple 24 secures the back panel 20*b* adjacent the free edge 20*b'* thereof. The matches are adapted to be partially enclosed by the back panel 20*b*. A friction strip 25 is positioned on the other end of the back panel 20*b*. As shown in FIG. 12, that end of the back panel 20*b* and the friction strip 25 thereon are securely positioned between the retainer flap 20*c* and the matches 22 so that the friction strip 25 is not normally sufficiently exposed for striking of the matches 22 thereon because the other end of the back panel 20*b* and retainer flap 20*c* are releasably interconnected by a pair of adhesive strips 26*a*, 26*b* on the other end of the back panel 20*b* immediately adjacent and on opposite sides of the friction strip 25. By this means, the friction strip 25 can only be exposed for striking of the matches thereon by release of the adhesive interconnections between the other end of the back panel 20*b* and the retainer flap 20*c* so that the retainer flap can be pulled upwardly about the staple 24 (FIG. 13) to expose the striking strip 25. The release of the interconnections between the back panel 20*b* and the retainer flap 20*c* may be similar to the manner of that described above with respect to the first embodiment and similar to that shown in FIGS. 6 through 9 but of course the back panel 20*b* cannot be pulled outwardly because of its securement by the staple 24. As a result of this construction, the friction strip is not normally sufficiently exposed so that the matches cannot be struck thereon. As in the first embodiment, if a child or other person who does not appreciate the danger of matches, plays with or handles those matches, he will most likely tear the cover open without exposing the striking surface. The striking surface can only be exposed by release of the adhesive interconnections between the back panel 20*b* and the retainer flap 20*c***.

For the purpose of normally opening the cover of the match book of the second embodiment, the front panel **20*a* may have a transversely extending line of perforations cut therein so that the front panel 20*a* can be easily opened by tearing it along the perforations. The line of perforations 27 is preferably positioned adjacent the other end of the front panel 20*a* as shown in FIG. 10.** After such tearing, the larger portion of the separated panel can be tucked into the smaller portion for closing the cover.

It is also contemplated in this invention that the part of the cover carrying the striking strip and the retainer flap could be interconnected by various mechanical fastenings instead of the adhesive interconnections described above and shown in the drawings. Also, because of the provision of adhesive strips adjacent the friction strip in the embodiments described above, it may be desirable to make the retainer flap wider than that of conventional match books so as to easily accommodate the friction strip and the strips of adhesive.

It is believed apparent from the above, that the safety match book of this invention is extremely safe, simple in construction and easy to manufacture and should help prevent unnecessary burn injuries to children or other persons not familiar with the dangers of matches.

What I claim is:

1. A safety match book comprising:

a match book cover comprising:

an openable and closable front panel closure flap;

a back panel connected at one end to one end of said front panel closure flap;

an imperforate retainer flap extending from the other end of the back panel;

matches secured between the back panel and the retaining flap and adapted to be partially enclosed by the closure flap;

a friction strip on the other end of the front panel closure flap, said other end of the front panel closure flap and the friction strip thereon being normally positioned between the retainer flap and the matches so that the friction strip is not sufficiently exposed for striking of the matches thereon; and means, completely covered by the retainer flap when the front panel closure flap is closed, for releasably interconnecting the other end of the closure flap and the retainer flap whereby the friction strip can only be exposed for striking of the matches thereon by release of the interconnecting means so that the other end of the closure flap and the friction strip thereon can be removed from normal position between the retainer flap and the matches.

2. A safety match book as claimed in claim 1, wherein:

said cover is thin and is made of a material which is easily tearable.

3. A safety match book comprising:

a match book cover comprising:

an openable and closable front panel closure flap;

a back panel connected at one end to one end of said front panel closure flap;

a retainer flap extending from the other end of the back panel;

matches secured between the back panel and the retaining flap and adapted to be partially enclosed by the closure flap;

a friction strip on the other end of the front panel closure flap, said other end of the front panel closure flap and the friction strip thereon being normally positioned between the retainer flap and the matches so that the friction strip is not sufficiently exposed for striking of the matches thereon;

said retainer flap being so constructed that when the other end of the front panel closure flap and the friction strip thereon are normally positioned between the retainer flap and the matches, no substantial portion of the friction strip is exposed so that the matches cannot be struck thereon; and means, completely covered by the retainer flap when the front panel closure flap is closed, for releasably interconnecting the other end of the closure flap and the retainer flap whereby the friction strip can only be exposed for striking of the matches thereon by release of the interconnecting means so that the other end of the closure flap and the friction strip thereon can be removed from normal position between the retainer flap and the matches.

4. A safety match book comprising:

a front panel closure flap;

a back panel connected at one end to one end of said front panel closure flap;

a retainer flap extending from the other end of the back panel;

matches secured between the back panel and the retainer flap and adapted to be partially enclosed by the closure flap;

a friction strip on the other end of the front panel closure flap, said other end of the front panel closure flap and the friction strip thereon being normally positioned between the retainer flap and the matches so that the friction strip is not sufficiently exposed for striking of the matches thereon; and an adhesive for releasably interconnecting the other end of the closure flap and the retainer flap whereby the friction strip can only be exposed for striking of the matches thereon by release of the adhesive interconnection between the other end of the closure flap and the retainer flap so that the other end of the closure flap and the friction strip thereon can be removed from normal position between the retainer flap and the matches.

5. A safety match book as claimed in claim 4, wherein:

said cover is thin and is made of a material which is easily tearable.

6. A safety match book as claimed in claim 4, wherein:

said adhesive is completely covered by the retainer flap when the other end of the front panel closure flap and the friction strip thereon are normally positioned between the retainer flap and the matches.

7. A safety match book comprising:

a front panel closure flap;

a back panel connected at one end to one end of said front panel closure flap;

a retainer flap extending from the other end of the back panel;

matches secured between the back panel and the retainer flap and adapted to be partially enclosed by the closure flap;

a friction strip on the other end of the front panel closure flap, said other end of the front panel closure flap and the friction strip thereon being normally positioned between the retainer flap and the matches so that the friction strip is not exposed for striking of the matches thereon; and a pair of adhesive strips, on the other end of the front panel closure flap immediately adjacent and on opposite sides of the friction strip, for releasably interconnecting the other end of the closure flap and the retainer flap, whereby the friction strip can only be exposed for striking of the matches thereon by release of the adhesive connections between the other end of the closure flap and the retainer flap so that the other end of the closure flap and the friction strip thereon can be removed from normal position between the retainer flap and the matches.

8. A safety match book as claimed in claim 7, wherein:

said cover is thin and made of a material which is easily tearable.

9. A safety match book as claimed in claim 7, wherein:

said pair of adhesive strips are completely covered by the retainer flap when the other end of the front panel closure flap and the friction strip thereon are normally positioned between the retainer flap and the matches.

10. A safety match book comprising:

a match book cover comprising:

a back panel connected at one end to one end of said front panel closure flap;

a retainer flap extending from the other end of the back panel;

matches secured between the back panel and the retainer flap and adapted to be partially enclosed by the closure flap;

a friction strip on the other end of the front panel closure flap, said other end of the front panel closure flap and the friction strip thereon being normally positioned between the retainer flap and the matches so that the friction strip is not sufficiently exposed for striking of the matches thereon;

said cover having a line of tear perforations cut therein whereby the cover can be easily opened by tearing thereof along the perforations; and means, completely covered by the retainer flap when the front panel closure flap is closed, for releasably interconnecting the other end of the closure flap and the retainer flap whereby the friction strip can only be exposed for striking of the matches thereon by release of the interconnecting means so that the other end of the closure flap and the friction strip thereon can be removed from normal position between the retainer flap and the matches.

11. A safety match book comprising:

a match book cover comprising:

a front panel closure flap;

a back panel connected at one end to one end of said front panel closure flap;

a retainer flap extending from the other end of the back panel;

matches secured between the back panel and the retaining flap and adapted to be partially enclosed by the closure flap;

a friction strip on the other end of the front panel closure flap, said other end of the front panel closure flap and the friction strip thereon being normally positioned between the retainer flap and the matches so that the friction strip is not sufficiently exposed for striking of the matches thereon;

said cover having a line of tear perforations cut therein whereby the cover can be easily opened by tearing thereof along the perforations; and an adhesive for releasably interconnecting the other end of the closure flap and the retainer flap whereby the friction strip can only be exposed for striking of the matches thereon by release of the adhesive interconnection between the other end of the closure flap and the retaining flap so that the other end of the closure flap and the friction strip thereon can be removed from normal position between the retainer flap and the matches.

12. A safety match book as claimed in claim 11, wherein:

said adhesive is completely covered by the retainer flap when the other end of the front panel closure flap and the friction strip thereon are normally positioned between the retainer flap and the matches.

13. A safety match book comprising:

a match book cover comprising:

a front panel closure flap;

a back panel connected at one end to one end of said front panel closure flap;

a retainer flap extending from the other end of the back panel;

matches secured between the back panel and the retaining flap and adapted to be partially enclosed by the closure flap;

a friction strip on the other end of the front panel closure flap, said other end of the front panel closure flap and the friction strip thereon being normally positioned between the retainer flap and the matches so that the friction strip is not sufficiently exposed for striking of the matches thereon;

said cover having a line of tear perforations cut therein whereby the cover can be easily opened by tearing thereof along the perforations; and a pair of adhesive strips, on the other end of the front panel closure flap immediately adjacent and on opposite sides of the friction strip, for releasably interconnecting the other end of the closure flap and the retainer flap whereby the friction strip can only be exposed for striking of the matches thereon by release of the adhesive connections between the other end of the closure flap and the retainer flap so that the other end of the closure flap and the friction strip thereon can be removed from normal position between the retainer flap and the matches.

14. A safety match book as claimed in claim 13, wherein:

said pair of adhesive strips are completely covered by the retainer flap when the other end of the front panel closure flap and the friction strip thereon are normally positioned between the retainer flap and the matches.

15. A safety match book comprising:

a match book cover comprising:

an openable and closable front panel closure flap;

a back panel connected at one end to one end of said front panel closure flap;

a retainer flap extending from the other end of the back panel and terminating in a free edge;

matches secured between the back panel and the retainer flap and adapted to be partially enclosed by the closure flap;

a friction strip on the other end of the front panel closure flap, said other end of the front panel closure flap and the friction strip thereon being normally positioned between the retainer flap and the matches so that the friction strip is not sufficiently exposed for striking of the matches thereon;

said front panel closure flap having a line of tear perforations cut therein adjacent and substantially parallel to the friction strip and positioned immediately adjacent the free edge of the retainer flap when the front panel closure flap is in its normal position whereby the cover can be easily opened by tearing along the perforations; and means, completely covered by the retainer flap when the front panel closure flap is closed, for releasably interconnecting the other end of the closure flap and the retainer flap whereby the friction strip can only be exposed for striking of the matches thereon by release of the interconnecting means so that the other end of the closure flap and the friction strip thereon can be removed from normal position between the retainer flap and the matches.

16. A safety match book comprising:

a match book cover comprising:

a front panel closure flap;

a back panel connected at one end to one end of said front panel closure flap;

a retainer flap extending from the other end of the back panel and terminating in a free edge;

matches secured between the back panel and the retainer flap and adapted to be partially enclosed by the closure flap;

a friction strip on the other end of the front panel closure flap, said other end of the front panel closure flap and the friction strip thereon being normally positioned between the retainer flap and the matches so that the friction strip is not exposed for striking of the matches thereon;

said front panel closure flap having a line of tear perforations cut therein adjacent and substantially parallel to the friction strip and positioned immediately adjacent the free edge of the retainer flap when the front panel closure flap is in its normal position whereby the cover can be easily opened by tearing along the perforations; and an adhesive for releasably interconnecting the other end of the closure flap and the retainer flap whereby the friction strip can only be exposed for striking of the matches thereon by release of the adhesive interconnection between the other end of the closure flap and the retainer flap so that the other end of the closure flap and the friction strip thereon can be removed from normal position between the retainer flap and the matches.

17. A safety match book as claimed in claim 16, wherein:

said adhesive is completely covered by the retainer flap when the other end of the front panel closure flap and the friction strip thereon are normally positioned between the retainer flap and the matches.

18. A safety match book comprising:

a match book cover comprising;

a back panel;

a front panel closure member connected at one end to one end of said back panel and terminating in a free edge;

a retainer flap extending from the other end of the back panel and terminating in a free edge;

matches secured between the back panel and the retainer flap and adapted to be partially enclosed by the closure flap;

a friction strip on the other end of the front panel closure flap, said other end of the front panel closure flap and the friction strip thereon being normally positioned between the retainer flap and the matches so that the friction strip is not sufficiently exposed for striking of the matches thereon;

a pair of adhesive strips, on the other end of the front panel closure flap immediately adjacent and on opposite sides of the friction strip, for releasably interconnecting the other end of the closure flap and the retainer flap whereby the friction strip can only be exposed for striking of the matches thereon by release of the adhesive connections between the other end of the closure flap and the retainer flap so that the other end of the closure flap and the friction strip thereon can be removed from normal position between the retainer flap and the matches; and said front panel closure flap having a line of tear perforations cut therein adjacent and substantially parallel to the adhesive strip most distant from the free edge of the closure flap on the side thereof so most distant and positioned immediately adjacent the free edge of the retainer flap when the front panel closure flap is in its normal position whereby the cover can be easily opened by tearing along the perforations.

19. A safety match book as claimed in claim 18, wherein:

said pair of adhesive strips are completely covered by the retainer flap when the other end of the front panel closure flap and the friction strip thereon are normally positioned between the retainer flap and the matches.

20. A safety match book comprising:

a match book cover comprising:

an openable front panel;

a back panel connected at one end to one end of said front panel;

a retainer flap extending from the other end of the front panel;

matches secured between the front panel and the back panel and adapted to be partially enclosed by the back panel;

a friction strip on the other end of the back panel, said other end of the back panel and the friction strip thereon being substantially fixedly positioned between the retainer flap and the matches so that the friction strip is not normally sufficiently exposed for striking of the matches thereon; and means for releasably interconnecting the retainer flap and the other end of the back panel whereby the friction strip can only be exposed for striking of the matches thereon by release of the interconnecting means so that the retainer flap can be moved away from the friction strip on the back panel.

21. A safety match book as claimed in claim 20, wherein:

said front panel has a transversely extending line of perforations cut therein whereby the front panel can be easily opened by tearing along the perforations.

22. A safety match book as claimed in claim 21, wherein:

said line of perforations is positioned adjacent the other end of the front panel.

23. A safety match book as claimed in claim 20, wherein:

the releasably interconnecting means are normally completely covered by the retainer flap.

24. A safety match book comprising:

a match book cover comprising:

an openable front panel;

a back panel connected at one end to one end of the front panel;

a retainer flap extending from the other end of the front panel;

matches secured between the front panel and the back panel and adapted to be partially enclosed by the back panel;

a friction strip on the other end of the back panel;

said other end of the back panel and the friction strip thereon being substantially fixedly positioned between the retainer flap and the matches so that the friction strip is not normally sufficiently exposed for striking of the matches thereon; and an adhesive for releasably interconnecting the retainer flap and the other end of the back panel whereby the friction strip can only be exposed for striking of the matches thereon by release of the adhesive interconnection between the other end of the back panel and the retainer flap so that the retainer flap can be moved away from the friction strip on the back panel.

25. A safety match book as claimed in claim 24, wherein:

said front panel has a transversely extending line of perforations cut therein whereby the front panel can be easily opened by tearing along the perforations.

26. A safety match book as claimed in claim 25, wherein:

said line of perforations is positioned adjacent the other end of the front panel.

27. A safety match book as claimed in claim 24, wherein:

said adhesive is normally completely covered by the retainer flap.

28. A safety match book comprising:

a match book cover comprising:

an openable front panel;

a back panel connected at one end to one end of said front panel;

a retainer flap extending from the other end of the front panel;

matches secured between the front panel and the back panel and adapted to be partially enclosed by the back panel;

a friction strip on the other end of the back panel, said other end of the back panel and the friction strip thereon being substantially fixedly positioned between the retainer flap and the matches so that the friction strip is not normally sufficiently exposed for striking of the matches thereon; and a pair of adhesive strips, on the other end of the back panel immediately adjacent and on opposite sides of the friction strip, for releasably interconnecting the retainer flap and the other end of the back panel whereby the friction strip can only be exposed for striking of the matches thereon by release of the adhesive connections between the other end of the back panel and the retainer flap so that the retainer flap can be moved away from the friction strip on the back panel.

29. A safety match book as claimed in claim 28, wherein:

said front panel has a transversely extending line of perforations cut therein whereby the front panel can be easily opened by tearing along the perforations.

30. A safety match book as claimed in claim 29, wherein:

said line of perforations is positioned adjacent the other end of the front panel.

31. A safety match book as claimed in claim 28, wherein:

said pair of adhesive strips are normally completely covered by the retainer flap.

* * * * *